US009177709B2

(12) United States Patent
Parthasarathy et al.

(10) Patent No.: US 9,177,709 B2
(45) Date of Patent: Nov. 3, 2015

(54) STRUCTURE AND METHOD FOR HIGH PERFORMANCE MULTI-PORT INDUCTOR

(71) Applicant: International Business Machines Corporation, Armonk, NY (US)

(72) Inventors: Shyam Parthasarathy, Bangalore (IN); Venkata Narayana Rao Vanukuru, Bangalore (IN); Randy Lee Wolf, Essex Junction, VT (US)

(73) Assignee: GLOBALFOUNDRIES INC., Grand Cayman (KY)

( * ) Notice: Subject to any disclaimer, the term of this patent is extended or adjusted under 35 U.S.C. 154(b) by 15 days.

(21) Appl. No.: 14/018,451

(22) Filed: Sep. 5, 2013

(65) Prior Publication Data

US 2015/0061812 A1 Mar. 5, 2015

(51) Int. Cl.
*H01F 5/00* (2006.01)
*H01F 17/00* (2006.01)

(52) U.S. Cl.
CPC ..... *H01F 17/0013* (2013.01); *H01F 5/00* (2013.01); *H01F 2017/0053* (2013.01); *H01F 2017/0073* (2013.01)

(58) Field of Classification Search
CPC ..... H01F 5/00; H01F 27/00–27/30
USPC ..... 336/65, 83, 200, 232; 257/531
See application file for complete search history.

(56) References Cited

U.S. PATENT DOCUMENTS

| | | | | |
|---|---|---|---|---|
| 5,656,849 | A | 8/1997 | Burghartz et al. | |
| 6,420,773 | B1 | 7/2002 | Liou | |
| 6,922,128 | B2 | 7/2005 | Vilander et al. | |
| 7,400,025 | B2 * | 7/2008 | Pitts et al. | 257/531 |
| 7,498,948 | B1 | 3/2009 | Gudeman et al. | |
| 7,612,645 | B2 * | 11/2009 | Yeh et al. | 336/200 |
| 2002/0067235 | A1 * | 6/2002 | Ueda et al. | 336/200 |
| 2003/0210121 | A1 | 11/2003 | Beng et al. | |
| 2004/0017278 | A1 | 1/2004 | Castaneda et al. | |
| 2005/0104158 | A1 | 5/2005 | Bhattacharjee et al. | |
| 2012/0223411 | A1 | 9/2012 | Cho et al. | |
| 2013/0032923 | A1 | 2/2013 | Lin et al. | |

OTHER PUBLICATIONS

Wang, Yong et al.; A Novel Structure On-Chip Spiral Inductors With Gradually Changed Metal Line Width and Space; 2006 International Conference on Information Acquisition; pp. 540-544, Aug. 20-23, 2006; Weihai, China.

Hsu, Heng-Ming; Analytical Formula for Inductance of Metal of Various Widths in Spiral Inductors: IEEE Transactions on Electron Devices, vol. 51, No. 8 , pp. 1343-1346; Aug. 2004; US.

* cited by examiner

*Primary Examiner* — Tuyen Nguyen
(74) *Attorney, Agent, or Firm* — Ian D. MacKinnon; Yuanmin Cai; Howard M. Cohn

(57) ABSTRACT

A multi-port inductor structure for use in semiconductor applications such as high-performance RF filters and amplifiers is provided. Embodiments of the present invention may provide 3 metallization layers and two via layers. The metallization layers and via layers may be substantially stacked on top of each other to conserve space. Each metallization layer comprises a ring pattern. In embodiments, the top two ring patterns include a plurality of concentric bands, forming a spiral pattern. The third (bottom) ring may include a broken ring pattern. In embodiments, the second (middle) ring may include one or more spans to facilitate connection to the inner bands of the second ring. The spans connect inner bands to an outer perimeter region of the second ring. Multiple tap points along the bands and spans allow multiple inductance values to be obtained from the structure.

20 Claims, 12 Drawing Sheets

STRUCTURE AND METHOD FOR HIGH PERFORMANCE MULTI-PORT INDUCTOR

FIELD OF THE INVENTION

The present invention relates generally to semiconductors, and more particularly, to structures and methods for implementing high performance multi-port inductors.

BACKGROUND OF THE INVENTION

An inductor is one of the most important components for an electric circuit with a resistor, a capacitor, a transistor and a power source. The inductor has a coil structure where a conductor is wound many times as a screw or spiral form. The inductor suppresses a rapid change of a current by inducing the current in proportion to an amount of a current change. Herein, a ratio of counter electromotive force generated due to electromagnetic induction according to the change of the current flowing in a circuit is called an inductance (L).

Generally, the inductor is used for an Integrated Circuit (IC) for communication. High performance RF filters, and distributed amplifiers, such as those utilizing CDMA and/or GSM frequency bands, utilize inductors. In particular, inductors are used in a packaging technology for integrating many elements to a single chip, known as a System on Chip (SoC). Accordingly, an inductor having a micro-structure and good characteristics is needed. Particularly, in the case of implementing the inductor on a single wafer, the inductor formed on a substrate has considerable space requirements. It is therefore desirable to have an improved inductor for use in such applications.

SUMMARY OF THE INVENTION

One embodiment of the present invention provides a multi-port inductor structure, comprising: a plurality of metal layers, formed into a plurality of concentric bands; a plurality of via layers connecting the metal layers; a plurality of underpass connections connecting one or more concentric bands from the plurality of concentric bands to an outer perimeter of the multi-port inductor structure; wherein the plurality of concentric bands each have a width that decreases inwardly within the structure, and wherein an interspacing distance between concentric bands increases inwardly within the structure.

Another embodiment of the present invention provides a multi-port inductor structure, comprising: a first metal layer; a second metal layer disposed underneath the first metal layer; a third metal layer disposed underneath the second metal layer; a first via layer disposed between the first metal layer and the second metal layer; a second via layer disposed between the second metal layer and the third metal layer; wherein the first metal layer and second metal layer comprise a plurality of concentric bands, wherein the plurality of concentric bands each have a width that decreases inwardly within the structure, and wherein an interspacing distance between concentric bands increases inwardly within the structure. Another embodiment of the present invention provides a multi-port inductor structure, comprising: a first metal layer comprising a lip portion; a second metal layer disposed underneath the first metal layer; a third metal layer disposed underneath the second metal layer; a first via layer disposed between the first metal layer and the second metal layer; a second via layer disposed between the second metal layer and the third metal layer; wherein the first metal layer and second metal layer comprise a plurality of concentric bands, wherein the plurality of concentric bands each have a width that decreases inwardly within the structure, and wherein an interspacing distance between concentric bands increases inwardly within the structure, and wherein the second metal layer includes a span connecting an inner concentric band to an outer perimeter, and further comprising: a first tap point on the lip portion; and a second tap point on an intermediate concentric band.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting.

Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

Figure 1:
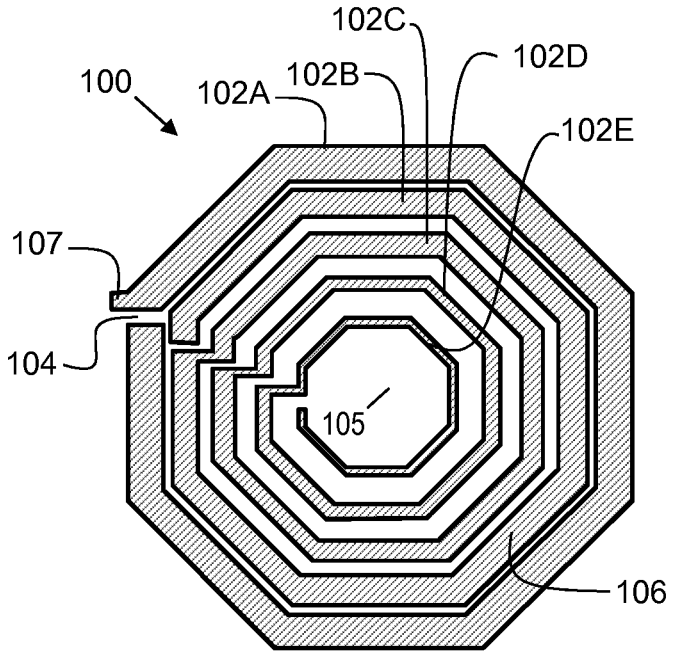

Often, similar elements may be referred to by similar numbers in various figures (FIGs) of the drawing, in which case typically the last two significant digits may be the same, the most significant digit being the number of the drawing figure (FIG). Furthermore, for clarity, some reference numbers may be omitted in certain drawings.

FIG. 1 is a top-down view of a first metal layer of an exemplary embodiment.

Figure 2:
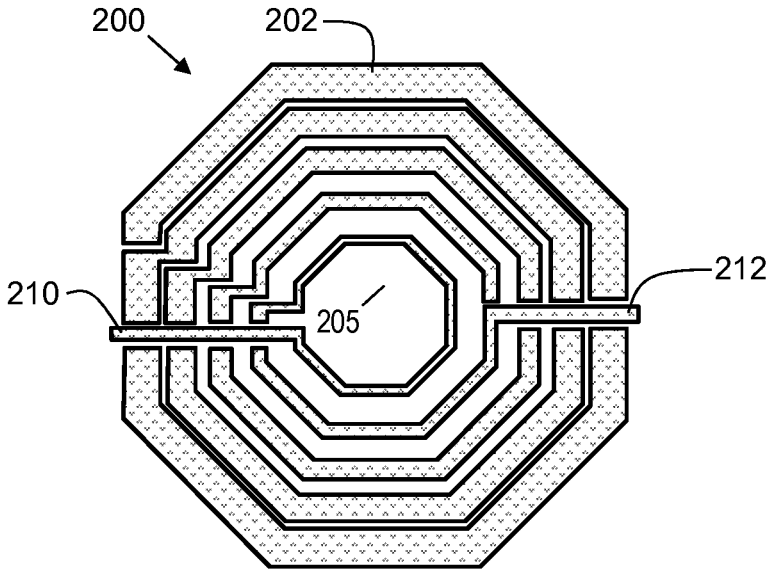

FIG. 2 is a top-down view of a second metal layer of an exemplary embodiment.

Figure 3:
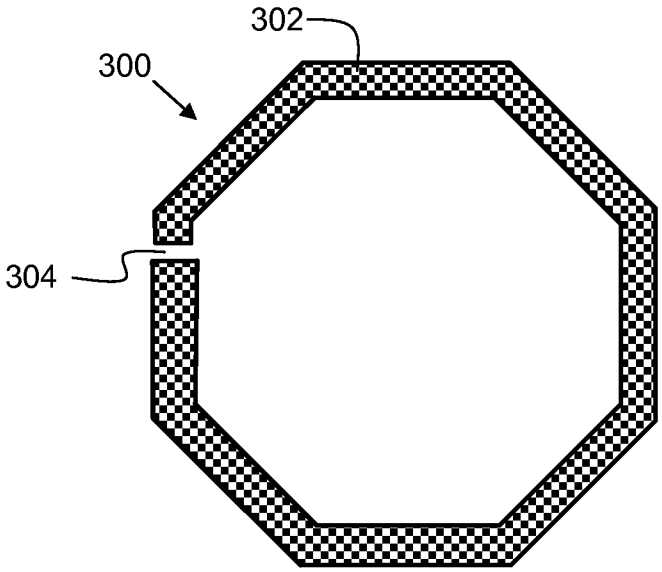

FIG. 3 is a top-down view of a third metal layer of an exemplary embodiment.

Figure 4:
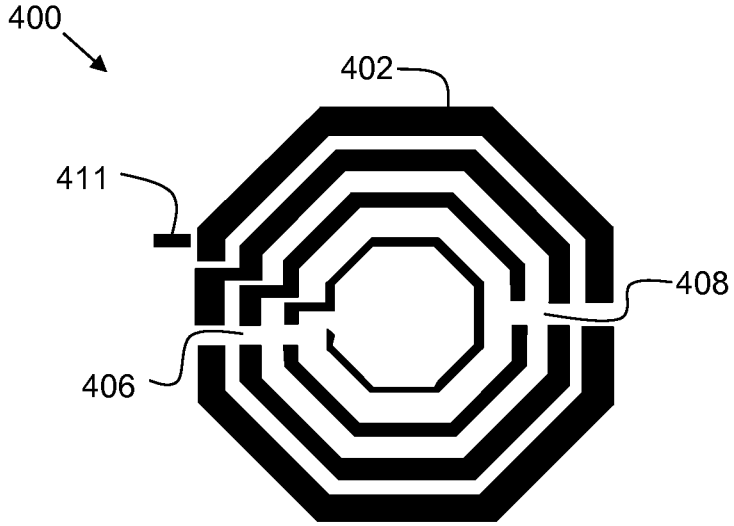

FIG. 4 is a top-down view of a first via layer of an exemplary embodiment.

Figure 5:
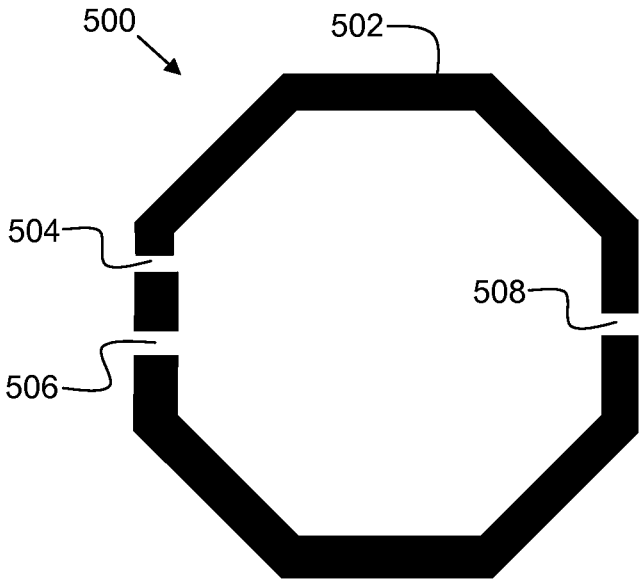

FIG. 5 is a top-down view of a second via layer of an exemplary embodiment.

Figure 6:
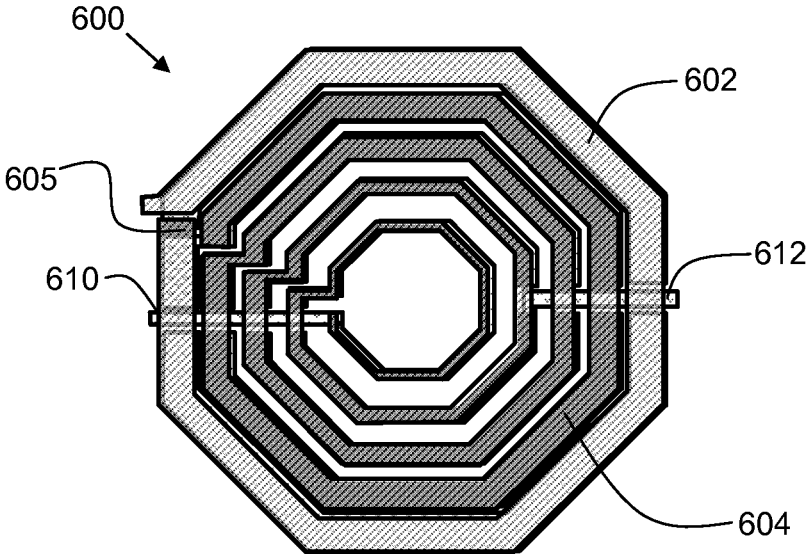

FIG. 6 is a top-down view of the first two metal layers and first via layer of an exemplary embodiment.

Figure 7:
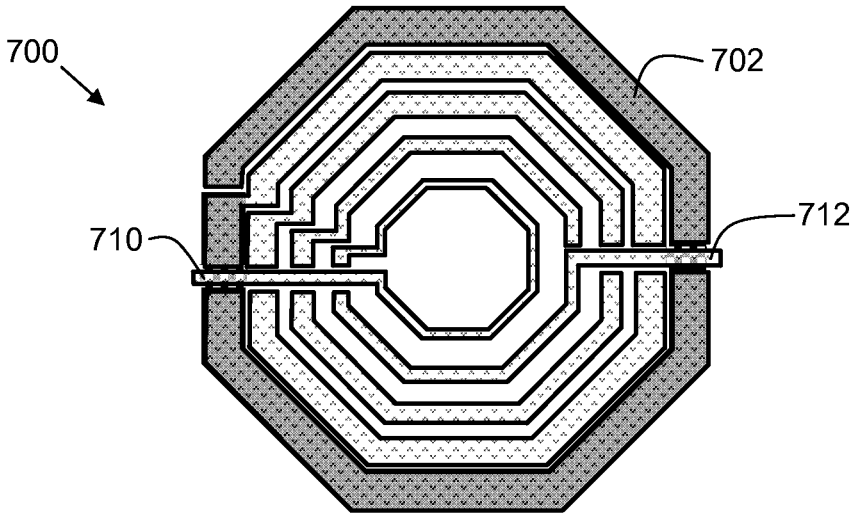

FIG. 7 is a top-down view of the second two metal layers and second via layer of an exemplary embodiment.

Figure 8:
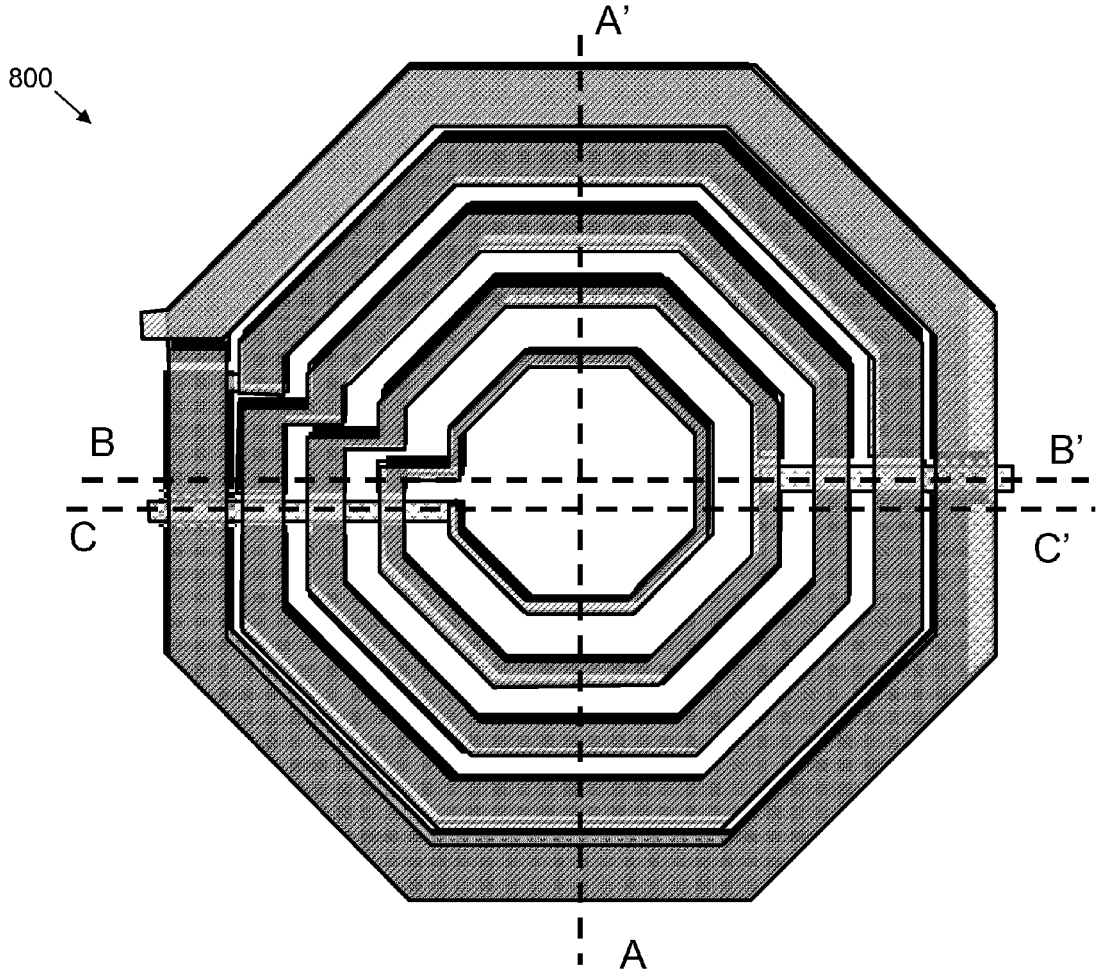

FIG. 8 is a top-down view of an inductor structure in accordance with exemplary embodiments.

Figure 9:
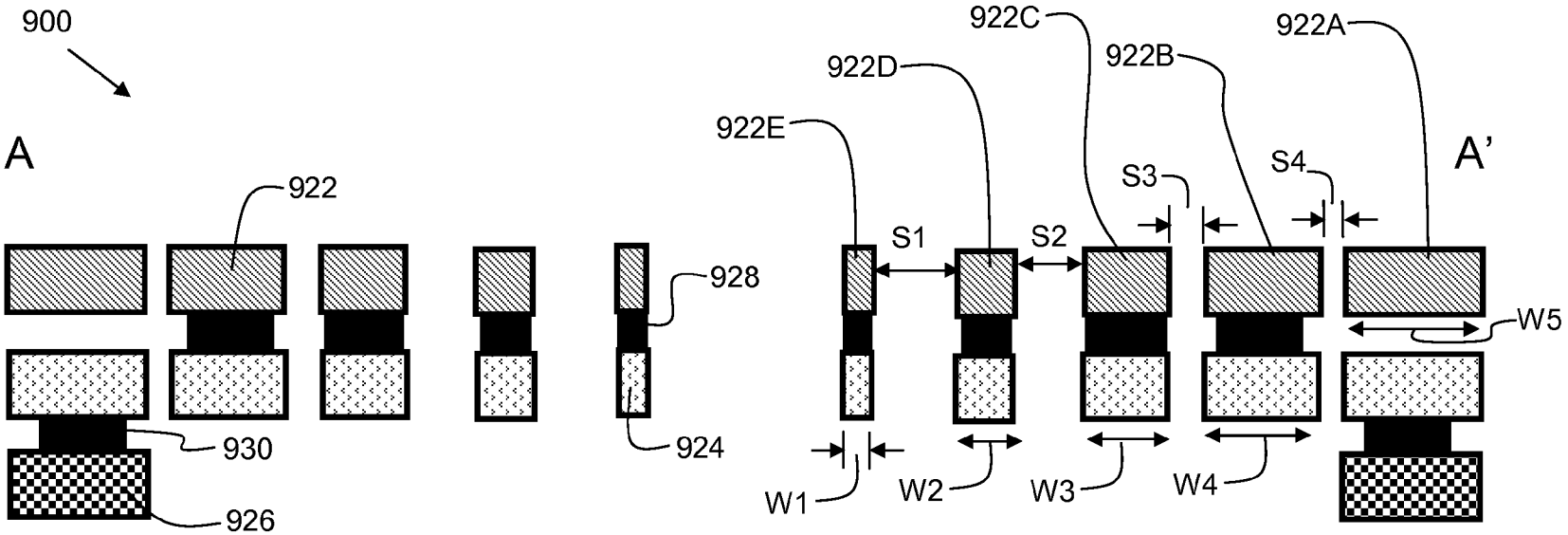

FIG. 9 is a cross section view along line A-A' of FIG. 8.

Figure 10:
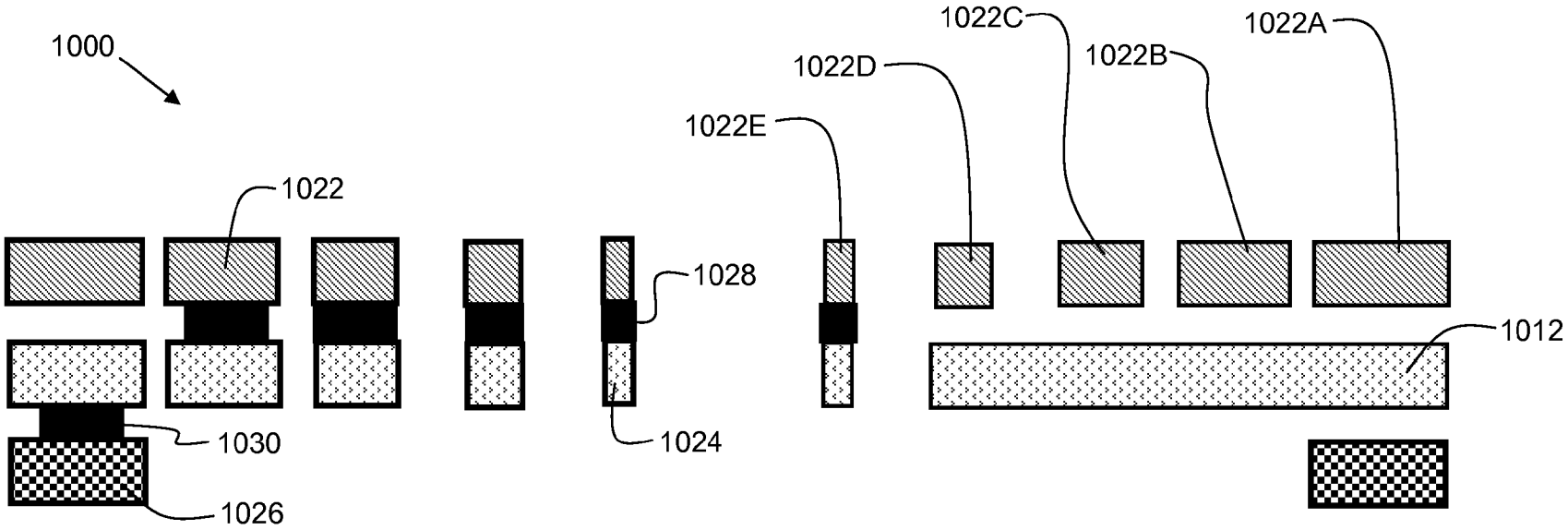

FIG. 10 is a cross section view along line B-B' of FIG. 8.

Figure 11:
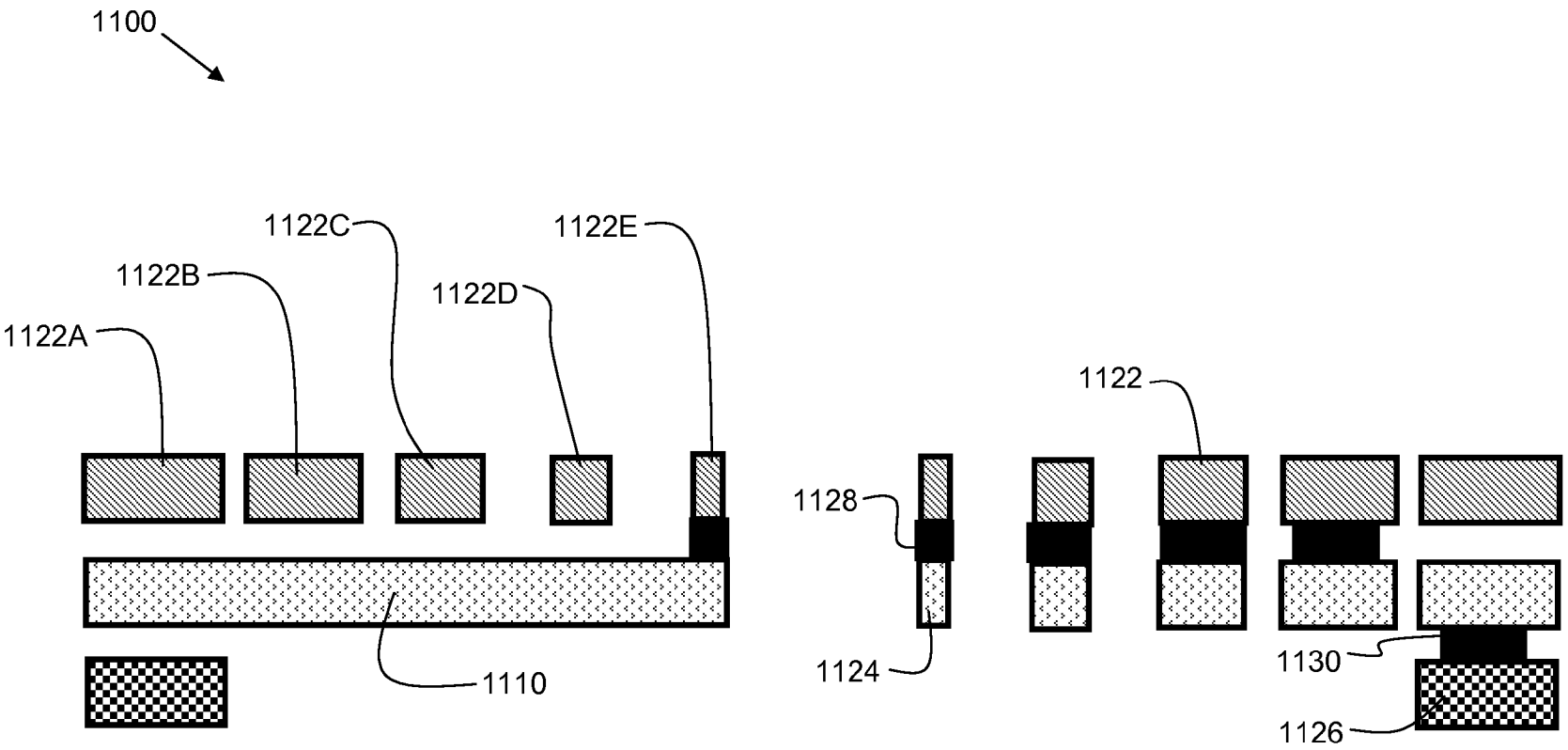

FIG. 11 is a cross section view along line C-C' of FIG. 8.

Figure 12:
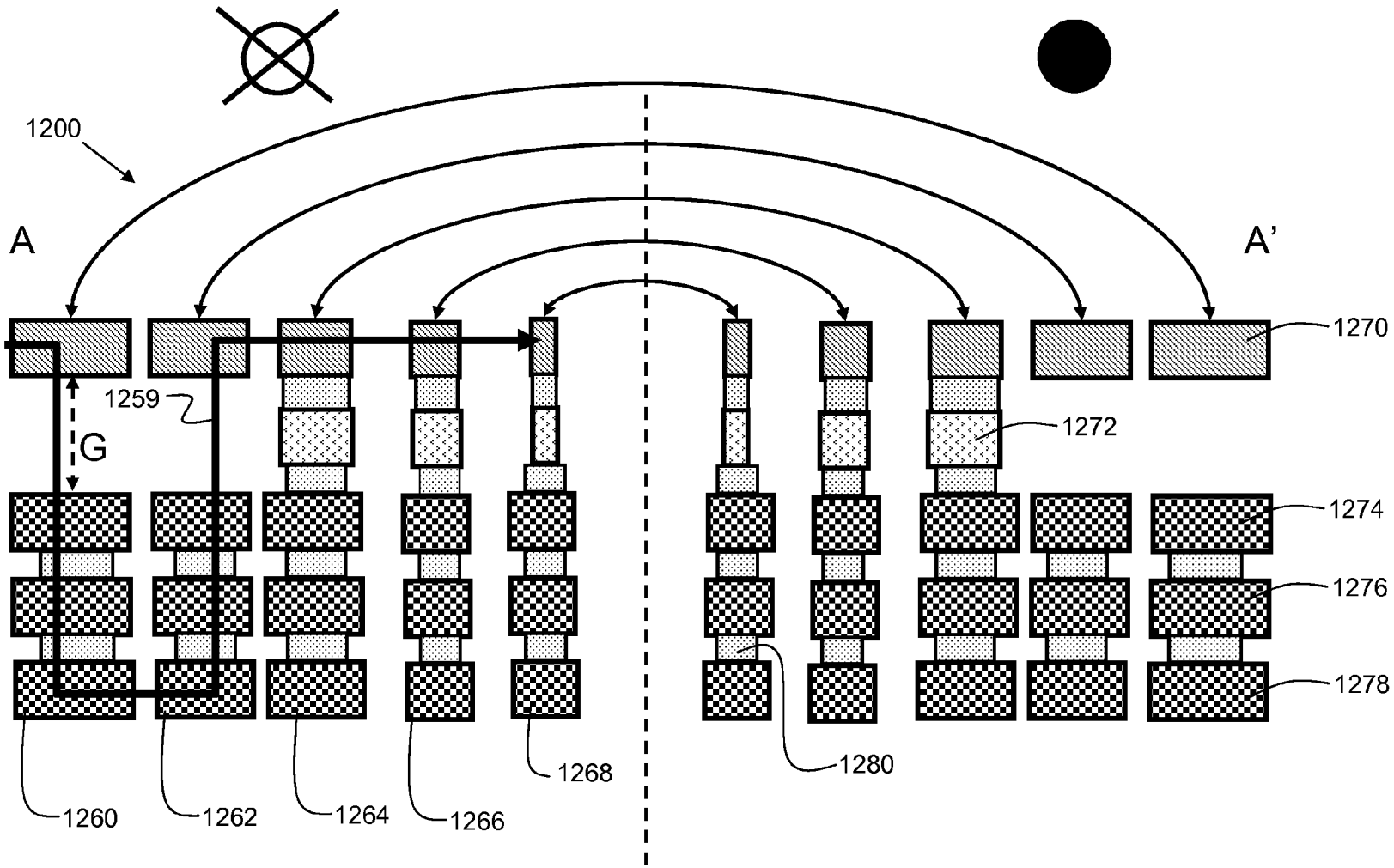

FIG. 12 is a cross section view along line A-A' of another alternative embodiment similar to FIG. 8.

Figure 13:
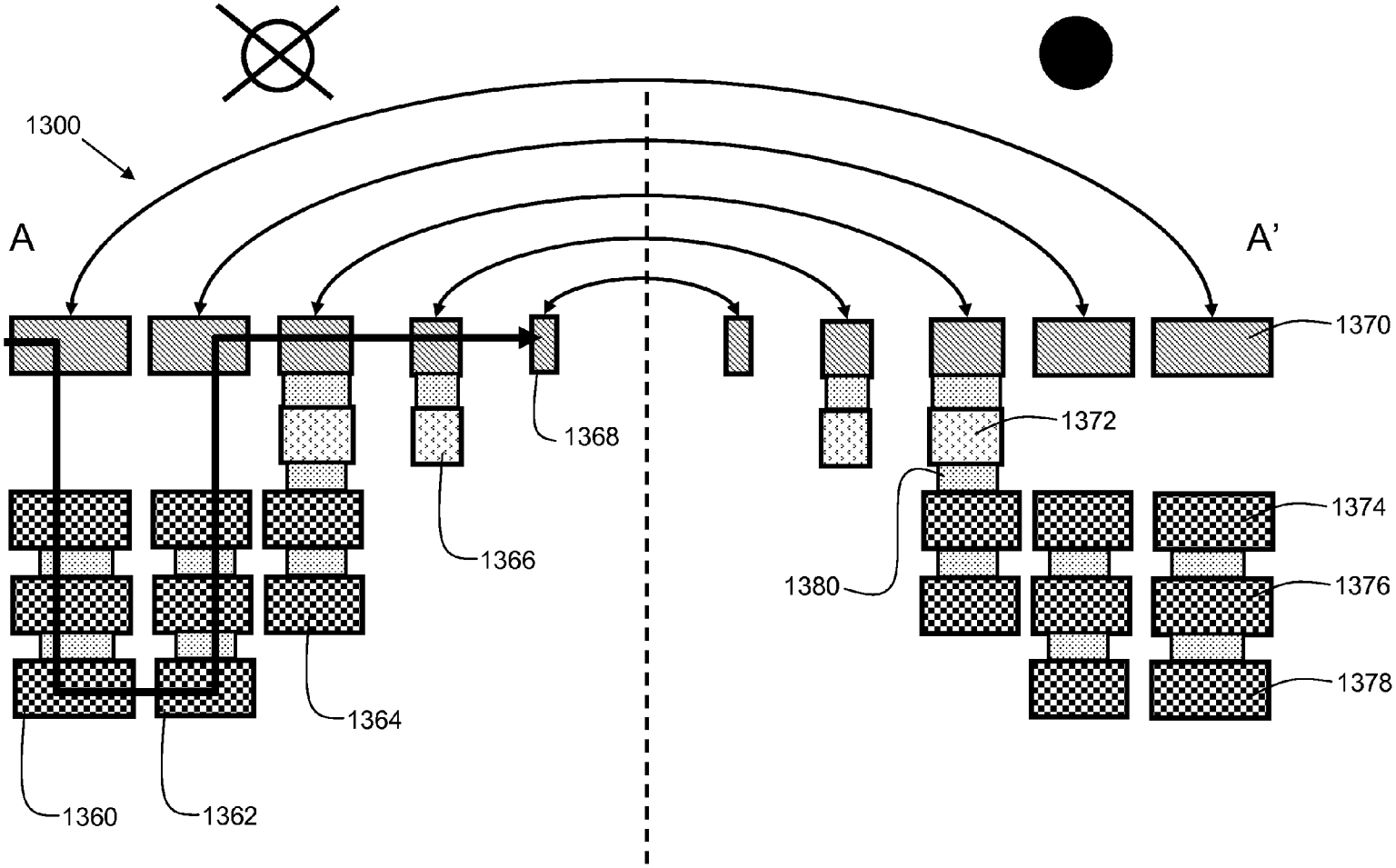

FIG. 13 is a cross section view along line A-A' of another alternative embodiment similar to FIG. 8.

Figure 14:
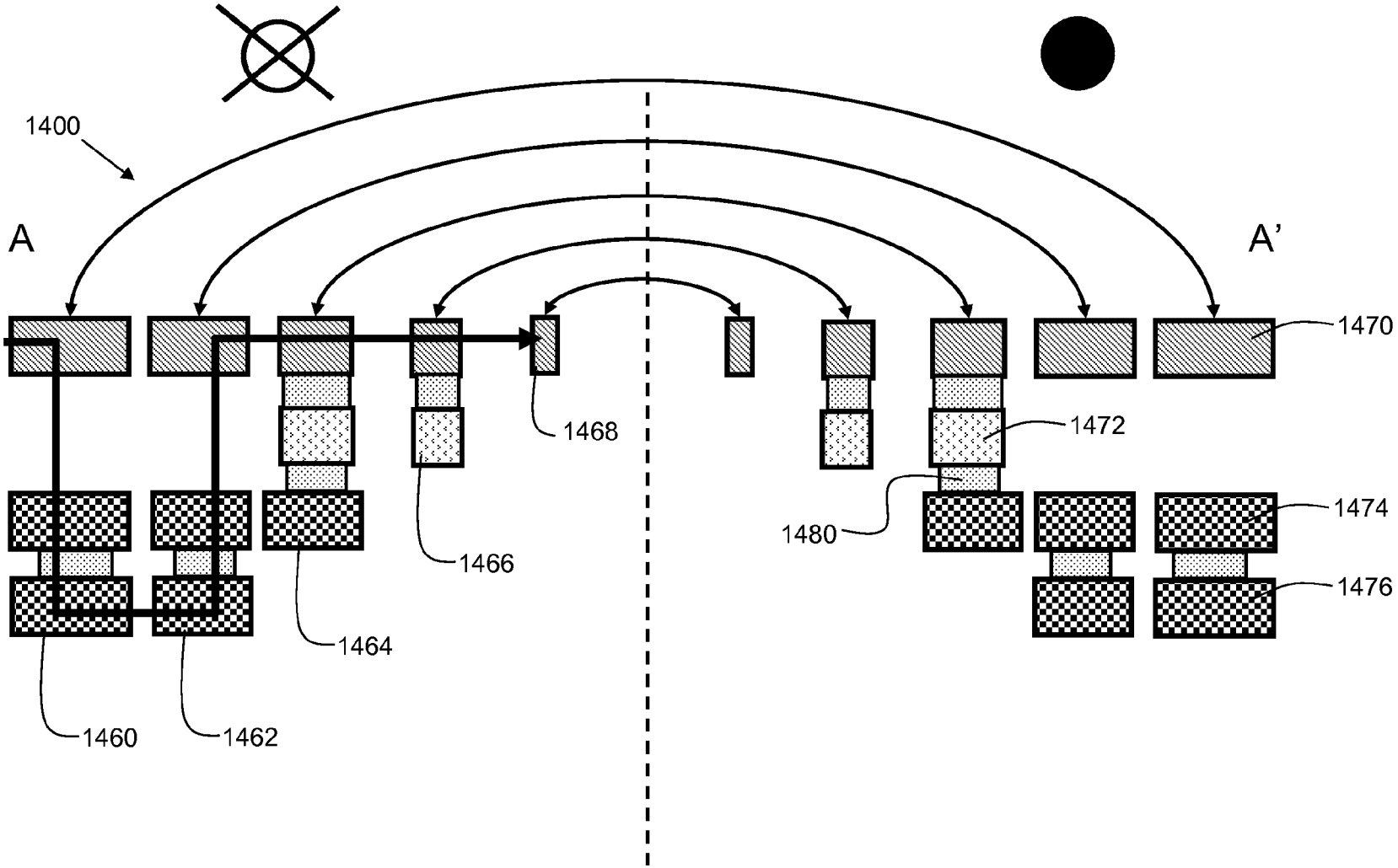

FIG. 14 is a cross section view along line A-A' of another alternative embodiment similar to FIG. 8.

Figure 15A:
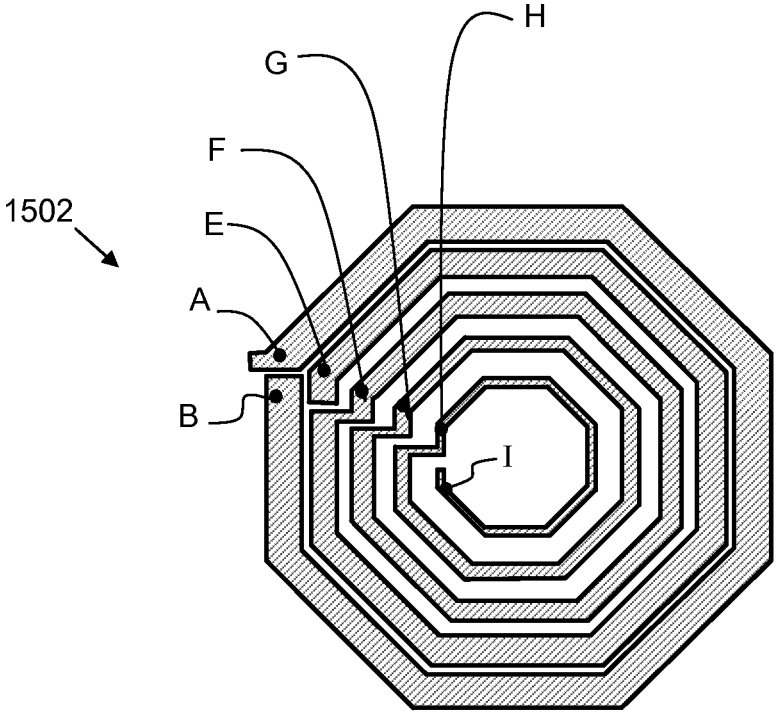
Figure 15B:
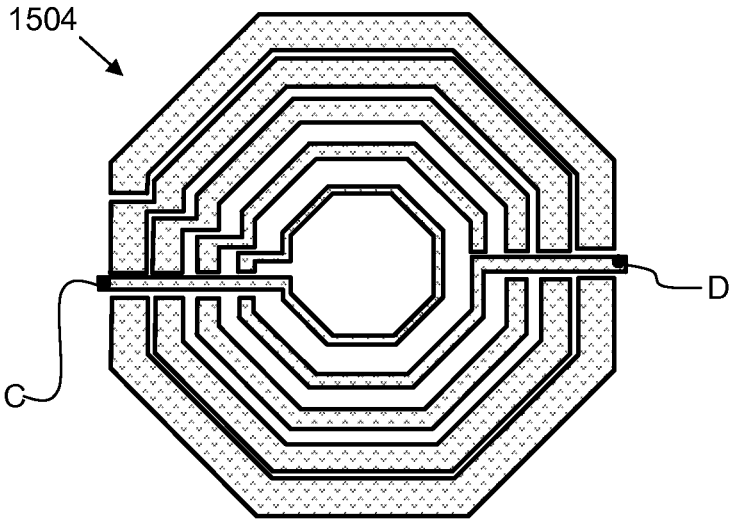

FIG. 15A and FIG. 15B show some possible tap points for embodiments of the present invention.

DETAILED DESCRIPTION

Embodiments of the present invention provide a multi-port inductor structure for use in semiconductor applications such as high-performance RF filters and amplifiers. Embodiments of the present invention may provide 3 metallization layers and two via layers. The metallization layers and via layers may be substantially stacked on top of each other to conserve space. Each metallization layer comprises a ring pattern. In embodiments, the top two ring patterns include a plurality of concentric bands, forming a spiral pattern. The third (bottom)

ring may include a broken ring pattern. In embodiments, the second (middle) ring may include one or more spans (underpass connections) to facilitate connection to the inner bands of the second ring. The spans connect inner bands to an outer perimeter region of the second ring. Embodiments of the present invention provide a multi-port inductor structure with reduced area requirements. Furthermore, high inductance and high Q values are provided across multiple frequency bands. The structure and performance provided by embodiments of the present invention make them well suited for silicon-on-insulator technologies.

FIG. 1 is a top-down view of a first metal layer 100 of an exemplary embodiment. Metal layer 100 is the top metal layer of the inductor structure and comprises an outer metal band 102A formed into a broken ring, having gap 104. Outermost metal band 102A further comprises lip portion 107 which juts out from the outer metal trace, and may be used as a contact point (tap point) for the inductor structure. Metal layer 100 further comprises inner concentric bands 102B, 102C, 102D, and 102E. The spiral of concentric bands is formed such that the width of the bands decreases inwardly within the structure, as they get closer to the center 105 of the metal layer 100. Furthermore, the interspacing distance between each band increases as they get closer to the center 105 of the metal layer 100.

FIG. 2 is a top-down view of a second metal layer 200 of an exemplary embodiment. Metal layer 200 is the middle layer of the inductor structure and comprises a series of concentric bands 202A-202E (referred to generally as "202"). The concentric bands are formed such that the width of the bands decreases as they get closer to the center 205 of the metal layer 200. Furthermore, the interspacing distance between each band increases as they get closer to the center 205 of the metal layer 200. In embodiments, metal layer 200 may include one or more spans (underpass connections) 210 and 212 which connect inner bands to an outer perimeter 213 of second metal layer 200. This facilitates adding tap points to the inner bands.

FIG. 3 is a top-down view of a third metal layer 300 of an exemplary embodiment. Metal layer 300 is the bottom layer of the inductor structure and comprises a metal trace 302 formed into a broken ring, having gap 304. The material for metal layers 100, 200 and 300 may include copper, tungsten, aluminum, or other suitable conductor. In some embodiments, the first metal layer 100, second metal layer 200, and third metal layer 300 may be formed in an octagonal shape. Other shapes, such as square, circle, rectangle, and hexagon may also be used in some embodiments.

FIG. 4 is a top-down view of a first via layer 400 of an exemplary embodiment. First via layer 400 is disposed between the first metal layer 100 and the second metal layer 200, and provides electrical connectivity between the first metal layer and the second metal layer. First via layer 400 comprises a plurality of concentric bands 402 that align with the inner concentric bands of the first and second via layers. Additionally, first via layer 400 comprises tab portion 411 which connects the outermost metal band 102A of the first metal layer 100 (FIG. 1) to the outermost band 202A of the second metal layer 200 (FIG. 2). Hence, a series connection is established between the outermost band 102A of metal layer 100 and the outermost band 202A of metal layer 200. Via layer 400 comprises voids 406 and 408 to accommodate the spans (210 and 212 of FIG. 2) which connect inner bands to an outer perimeter of second metal layer 200.

FIG. 5 is a top-down view of a second via layer 500 of an exemplary embodiment. Second via layer 500 is disposed between the second metal layer 200 and the third metal layer 300, and provides electrical connectivity between the second metal layer and the third metal layer. Second via layer 500 comprises a broken ring 502, with a gap 504 corresponding to gap 304 of third metal layer 300 (see FIG. 3). Second via layer 500 also comprises voids 506 and 508 to accommodate the spans (210 and 212 of FIG. 2) which connect inner bands to an outer perimeter of second metal layer 200.

FIG. 6 is a top-down view of an inductor structure 600 showing the first two metal layers and first via layer of an exemplary embodiment. Portion 605 indicates where the first metal layer is connected to the second metal layer. The inner bands 604 are in contact with the first via layer, forming a parallel connection. The spans 610 and 612 of the second metal layer are connected to the inner bands of the second metal layer. The spans go underneath the first metal layer, including underneath outermost band 602, but the spans are not in direct physical contact with the outermost band 602 and inner bands 604 due to the voids in the first via layer (see 406 and 408 of FIG. 4).

FIG. 7 is a top-down view of an inductor structure 700 showing the second two metal layers and second via layer of an exemplary embodiment. The outermost band 702 of the second metal layer is in contact with the second via layer 500 (see FIG. 5). The spans 710 and 712 of the second metal layer are connected to the inner bands of the second metal layer. The spans go above the third metal layer, but the spans are not in direct physical contact with the third metal layer due to the voids in the second via layer (see 506 and 508 of FIG. 5).

FIG. 8 is a top-down view of an inductor structure 800 in accordance with exemplary embodiments. In this figure, lines A-A', B-B', and C-C' represent slices for various cross sectional views that are further described below.

FIG. 9 is a cross section view of an inductor structure 900 along line A-A' of FIG. 8. First metal layer 922 is disposed on first via layer 928, which is disposed on second metal layer 924. Second metal layer 924 is disposed on second via layer 930, which is disposed on third metal layer 926. The left side of FIG. 9 represents endpoint A of line A-A' in FIG. 8, and the right side of FIG. 9 represents endpoint A' of line A-A' in FIG. 8. Individual concentric bands of the first layer are referenced individually on the right side of the figure. Outermost band 922A has a width W5. The next band 922B has a width W4. The next band 922C has a width W3. The next band 922D has a width W2. Bands 922B, 922C, and 922D are referred to as intermediate bands. The innermost band 922E has a width W1. The widths are decreasing towards the center of the structure such that W1<W2<W3<W4<W5. The interspacing between the concentric bands increases towards the center of the structure such that S1>S2>S3>S4. The width of the bands of the second metal layer 924 may be of a similar pattern (width and interspacing) as the first metal layer 922. In some embodiments, S1 ranges from about 20 nanometers to about 30 nanometers, S2 ranges from about 15 nanometers to about 19 nanometers, S3 ranges from about 10 nanometers to about 14 nanometers, and S4 ranges from about 6 nanometers to about 9 nanometers. In some embodiments, W1 ranges from about 6 nanometers to about 9 nanometers, W2 ranges from about 10 nanometers to about 14 nanometers, W3 ranges from about 15 nanometers to about 19 nanometers, W4 ranges from about 20 nanometers to about 25 nanometers, and W5 ranges from about 26 nanometers to about 33 nanometers. The rate at which width and interspacing of the concentric bands change going from the exterior to the interior of the structure is directly proportional to the frequency band spacing. In general, when designing an inductor structure for use within a narrow frequency range, the interspacing changes more gradually from the outer bands towards the center of the structure. Conversely, when designing an inductor structure for use within a wider frequency range, the interspacing changes more aggressively from the outer bands towards the center of the structure. Hence, interspacing is an important parameter to consider when designing inductor structures in accordance with embodiments of the present invention.

FIG. 10 is a cross section view of an inductor structure 1000 along line B-B' of FIG. 8. In this view, first metal layer 1022, first via layer 1028, second metal layer 1024, second via layer 1030, and third metal layer 1026 are shown. Furthermore, span 1012 is shown, which extends from the outermost band 1022A to the second to the most innermost concentric band 1022D.

FIG. 11 is a cross section view of an inductor structure 1100 along line along line C-C' of FIG. 8. In this view, first metal layer 1122, first via layer 1128, second metal layer 1124, second via layer 1130, and third metal layer 1126 are shown. Furthermore, span 1110 is shown, which extends from the outermost band 1122A to the innermost concentric band 1122E. However, span 1110 is not in direct physical contact with outermost band 112A, or intermediate bands 1122B, 1122C, and 1122D.

FIG. 12 is a cross section view of an inductor structure 1200 along line A-A' of another alternative embodiment similar to FIG. 8. From a top-down view, inductor structure 1200 is similar to what is shown in FIG. 8. However, the cross section view reveals multiple metal layers (1270, 1272, 1274, 1276, and 1278), and multiple bands (1260, 1262, 1264, 1266, and 1268). The bands may be configured in series, parallel, or standalone. Bands 1260 and 1262 are configured in a vertically solenoidal (up-down) series stacking, and bands 1264, 1266, and 1268 are configured in a parallel stack. The bands may have varying numbers of metal layers. For example, in structure 1200, bands 1260 and 1262 have 4 metal layers (1270, 1274, 1276, and 1278) while band 1264 has 5 metal layers (1270, 1272, 1274, 1276, and 1278). For a given band, the metal layers are substantially vertically aligned with one another. Arrow 1259 indicates the flow of current from the outer bands towards the inner bands of the structure 1200. In band 1260, current flows from metal layer 1270 to metal layer 1274 only in a localized area, to form the series connection (e.g. tab 411 of FIG. 4). In the localized area of the series connection, intermediate metal layers (such as metal layer 1272) may be present for the purposes of connecting other metal layers. In the majority of places along band 1260, a non-zero gap factor G exists between the first metal layer 1270 and the next metal layer within band 1260, which is metal layer 1274. Gap factor G may be used as an adjustable parameter in the design of inductor structures in accordance with embodiments of the present invention. Increasing the gap factor increases the dielectric spacing between metal layers within a given band, which serves to reduce undesired capacitance within the structure. In the view of FIG. 12, the structure appears symmetrical, and on the left side A, current flows into the page, as indicated by the crossed circle symbol. On the right side A', current flows out of the page, as indicated by the solid circle symbol.

FIG. 13 is a cross section view of an inductor structure 1300 along line A-A' of another alternative embodiment similar to FIG. 8. From a top-down view, inductor structure 1300 is similar to what is shown in FIG. 8. However, the cross section view reveals multiple metal layers (1370, 1372, 1374, 1376, and 1378), and multiple bands (1360, 1362, 1364, 1366, and 1368). In structure 1300, band 1368 is a standalone, single band. Bands 1364 and 1366 are parallel stacked bands, and bands 1360 and 1362 are configured in series winding. While bands 1364 and 1366 are both parallel stacked, the bands have different depths. Band 1364 has a depth of 4 metal layers (1370, 1372, 1374, and 1376), while band 1366 has a depth of two metal layers (1370 and 1372). In the view of FIG. 13, the structure appears symmetrical, and on the left side A, current flows into the page, as indicated by the crossed circle symbol. On the right side A', current flows out of the page, as indicated by the solid circle symbol.

FIG. 14 is a cross section view of an inductor structure 1400 along line A-A' of another alternative embodiment similar to FIG. 8. From a top-down view, inductor structure 1300 is similar to what is shown in FIG. 8. However, the cross section view reveals multiple metal layers (1470, 1472, 1474, 1476, and 1478), and multiple bands (1460, 1462, 1464, 1466, and 1468). Structure 1400 is similar to structure 1300, except that the band depth is reduced from that of structure 1300 (FIG. 13). In this case, band 1460 and band 1462 have a depth of 3 metal layers. Band 1464 has a depth of 3 metal layers, and band depth 1466 has a depth of two metal layers. Band 1468 is a single layer. In the view of FIG. 14, the structure appears symmetrical, and on the left side A, current flows into the page, as indicated by the crossed circle symbol. On the right side A', current flows out of the page, as indicated by the solid circle symbol.

Embodiments of the present invention can now be defined in general terms. An inductor structure in accordance with embodiments of the present invention may be described by:

$$N=R+P+Q$$

Where N is the total number of bands, R is the number of bands in series configuration, P is the number of bands in parallel stack configuration, and Q is the number of single bands. Referring again to FIGS. 12-14, structure 1200 is of the form (2,3,0), where it has two series configured bands, and 3 parallel stacked bands. Structures 1300 and 1400 are of the form (2,2,1), where they have two series configured bands, two parallel stacked bands, and 1 standalone (single) band. In some embodiments, one of R, P, or Q may be zero.

Additionally, each band B within an inductor structure can be specified in terms of a depth and a gap in the form of B(D,G), where D is a depth and G is a gap factor (in metal levels). For example bands 1260 and 1262 have four metal layers and a gap of 1 level (metal level 1272 is skipped in those bands), and so may be specified as B(4,1). Band 1264 has 5 levels and no gap, and thus is specified as B(5,0). Hence, band 1264 has a zero gap factor (G=0), and band 1260 and 1262 have a gap factor of 1 (G=1). In general, series configured bands may have a gap factor G where G is greater than or equal to zero.

FIG. 15A and FIG. 15B show some possible tap points for embodiments of the present invention. An inductor with a given value is formed by utilizing two tap points on the structure. FIG. 15A shows a first metal layer structure 1502 indicating tap points A, B, E, F, G, H, and I. Each pair of tap point provides a different possible inductance value. The inductance value most suitable for a particular application may be selected for a given design, and corresponding tap point locations may be selected. Tap point A is the outermost tap point on the lip portion of the first metal layer. The tap point corresponding to a particular inductance value may be obtained by computers executing simulation software. FIG. 15B shows a second metal layer structure 1504, having tap points C and D on the distal end of the spans. The peak Q value of the inductor structure decreases with increasing inductance. Selecting tap points between the outermost and innermost concentric bands (tap point A and tap point I) provide the inductor to be used at the lowest frequency band. Selecting tap points between the outermost and intermediate concentric bands (e.g. tap point A and tap point E, or tap point A and tap point F) provide the inductor to be used at intermediate frequencies. Selecting tap points between the intermediate and the innermost concentric bands (e.g tap point F to tap point I, or tap point G to tap point I) provide the inductor to be used at the highest frequencies. Contact structures (not shown) may be used to connect tap points to other parts of an integrated circuit when fabrication is complete. The contact structures may be comprised of tungsten or other suitable conductor, and may connect to other metallization layers within the integrated circuit. In some embodiments, the multi-port inductor structure may provide inductances ranging from about 100 nanohenries ("nH") to about 10 microhenries ("μH").

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, circuits, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed is:

1. A multi-port inductor structure, comprising:

a plurality of metal layers, formed into a plurality of concentric bands;

a plurality of via layers connecting the metal layers;

a plurality of underpass connections connecting one or more concentric bands from the plurality of concentric bands to an outer perimeter of the multi-port inductor structure;

wherein the plurality of concentric bands each have a width that decreases inwardly within the structure, and wherein an interspacing distance between concentric bands increases inwardly within the structure.

2. The structure of claim 1, wherein the plurality of concentric bands includes at least two bands configured in a vertically solenoidal series stacking.

3. The structure of claim 1, wherein the plurality of concentric bands includes at least one band configured in parallel.

4. The structure of claim 1, wherein the plurality of concentric bands includes at least one band configured as a single band.

5. The structure of claim 1, wherein the at least two bands configured in a vertically solenoidal series stacking further comprise a non-zero gap factor.

6. The structure of claim 2, wherein the plurality of concentric bands includes at least one band configured in parallel, and wherein the bands configured in a vertically solenoidal series stacking have a first depth, and the at least one band configured in parallel has a second depth.

7. The structure of claim 6, wherein the first depth is greater than the second depth.

8. A multi-port inductor structure, comprising:

a first metal layer;

a second metal layer disposed underneath the first metal layer;

a third metal layer disposed underneath the second metal layer;

a first via layer disposed between the first metal layer and the second metal layer;

a second via layer disposed between the second metal layer and the third metal layer;

wherein the first metal layer and second metal layer comprise a plurality of concentric bands, wherein the plurality of concentric bands each have a width that decreases inwardly within the structure, and wherein an interspacing distance between concentric bands increases inwardly within the structure, and wherein an interspacing distance between concentric bands increases inwardly within the structure.

9. The structure of claim 8, wherein the third metal layer is connected to the second metal layer on an outermost concentric band of the second metal layer.

10. The structure of claim 9, wherein the first metal layer is connected to the second metal layer on a plurality of intermediate concentric bands.

11. The structure of claim 9, wherein the plurality of concentric bands in the first metal layer comprises 5 concentric bands.

12. The structure of claim 8, wherein the second metal layer includes a span connecting an inner concentric band to an outer perimeter.

13. The structure of claim 8, wherein the third metal layer comprises a broken ring.

14. The structure of claim 12, wherein the span connects a second innermost concentric band to the outer perimeter.

15. The structure of claim 12, further comprising a second span connecting an innermost concentric band to the outer perimeter.

16. The structure of claim 8, wherein the first metal layer, second metal layer, and third metal layer are formed in a shape selected from the group consisting of: rectangular, hexagonal, circular, and octagonal shape.

17. The structure of claim 8, wherein the plurality of concentric bands in the first metal layer comprises 5 concentric bands.

18. A multi-port inductor structure, comprising:

a first metal layer comprising a lip portion;

a second metal layer disposed underneath the first metal layer;

a third metal layer disposed underneath the second metal layer;

a first via layer disposed between the first metal layer and the second metal layer;

a second via layer disposed between the second metal layer and the third metal layer;

wherein the first metal layer and second metal layer comprise a plurality of concentric bands, wherein the plurality of concentric bands each have a width that decreases inwardly within the structure, and wherein an interspacing distance between concentric bands increases inwardly within the structure, and wherein the second metal layer includes a span connecting an inner concentric band to an outer perimeter, and further comprising:

a first tap point on the lip portion; and a second tap point on an intermediate concentric band, and wherein an interspacing distance between concentric bands increases inwardly within the structure.

19. The structure of claim 18, further comprising a third tap point on an innermost concentric band.

20. The structure of claim 19, further comprising a fourth tap point on the span.

* * * * *